US005606621A

United States Patent [19]

Reiter et al.

[11] Patent Number: 5,606,621

[45] Date of Patent: Feb. 25, 1997

[54] HYBRID BEHIND-THE-EAR AND COMPLETELY-IN-CANAL HEARING AID

[75] Inventors: James J. Reiter, Champlin; Gordon Berkholcs, Minneapolis, both of Minn.

[73] Assignee: Siemens Hearing Instruments, Inc., Piscataway, N.J.

[21] Appl. No.: 490,214

[22] Filed: Jun. 14, 1995

[51] Int. Cl.[6] ..... H04R 25/00

[52] U.S. Cl. ..... 381/68.6; 381/68.7

[58] Field of Search ..... 381/23.1, 68, 68.1, 381/68.2, 68.3, 68.4, 68.5, 68.6, 68.7, 69, 69.1, 69.2; 181/129, 130, 134, 135; 128/864, 865, 866

[56] References Cited

U.S. PATENT DOCUMENTS

| | | | |
|---|---|---|---|
| 3,123,678 | 3/1964 | Prentiss et al. | 381/68.7 |
| 3,688,863 | 9/1972 | Johnson | 181/23 |
| 3,890,474 | 6/1975 | Glicksberg | 179/107 |
| 4,089,332 | 5/1978 | Rose | 128/865 |
| 4,606,329 | 8/1986 | Hough | 381/68.3 |
| 5,381,484 | 1/1995 | Claes et al. | 381/68.6 |

FOREIGN PATENT DOCUMENTS

| | | | |
|---|---|---|---|
| 0158391A1 | 10/1985 | European Pat. Off. . | |
| 0158391B1 | 10/1988 | European Pat. Off. . | |
| 2058158 | 5/1971 | France . | |
| 3508830A1 | 9/1986 | Germany . | |
| 3601440A1 | 7/1987 | Germany . | |
| 3638747C1 | 10/1987 | Germany . | |
| 3625891A1 | 2/1988 | Germany . | |
| 0151100 | 7/1987 | Japan | 381/68.7 |
| 92/13430 | 8/1992 | WIPO . | |

OTHER PUBLICATIONS

International Search Report.

William K. Vass, MS, and Laura A. Mims, MS; 'Exploring the deep canal fitting advantage'; Hearing Instruments; vol. 44, Number 12, 1993; pp. 26 & 27.

Gustav Mueller; 'CIC Hearing Aids: What Is Their Impact On The Occlusion Effect?'; The Hearing Journal; vol. 47, No. 11, Nov. 1994; pp. 29–35.

Webster's Ninth New Collegiate Dictionary, 1990, p. 392.

*Primary Examiner*—Forester W. Isen

*Attorney, Agent, or Firm*—Mark H. Jay

[57] ABSTRACT

A hybrid BTE and CIC hearing aid has a BTE component which is worn behind the patient's ear and a CIC component which is worn in the bony portion of the patient's ear canal. The BTE and CIC components are connected together with a wire cable. Electroacoustic feedback is reduced or eliminated, allowing gain to be increased. The patient is not disturbed by the occlusion effect.

3 Claims, 1 Drawing Sheet

HYBRID BEHIND-THE-EAR AND COMPLETELY-IN-CANAL HEARING AID

BACKGROUND OF THE INVENTION

The invention relates to hearing aids, and more particularly relates to high-gain hearing aids. In its most immediate sense, the invention relates to high-gain hearing aids which reduce the occlusion effect.

Patients with severe hearing loss require high-gain hearing aids. Such aids use high-power amplification circuitry. Conventionally, such circuitry uses comparatively large electrical components. For this reason, high-gain hearing aids are conventionally of the behind-the-ear ("BTE") type.

However, such aids suffer from a serious limitation. This is that as the gain of the aid is increased, electroacoustic feedback also increases. This is because the hearing aid microphone and receiver are mechanically coupled to each other because both are mounted to the same housing. As a result, the gain of the aid is limited by the electroacoustic feedback.

In the past, efforts have been made to reduce electroacoustic feedback by physically separating the microphone and the receiver used in the hearing aid. For example, *The Volta Review* 1-80 pp. 40–44 describes a hearing aid in which the receiver is separated from the main body of the aid and mounted in an earmold that in turn is placed in the patient's ear.

While such a hearing aid would reduce electroacoustic feedback, it would be commercially unacceptable. This is because such an instrument would cause the patient to experience the occlusion effect, which is the plugged, sensation caused by the introduction of e.g. an earmold in the outermost portion of the ear.

It would therefore be advantageous to provide a high-gain hearing aid that has reduced electroacoustic feedback characteristics while nonetheless being constructed to reduce or eliminate the occlusion effect.

In accordance with the invention, there is provided a hybrid BTE and completely-in-canal ("CIC") hearing aid. A hearing aid in accordance with the invention has two components: a BTE component and a CIC component. These components are mechanically isolated from each other. The BTE component, which is mounted behind the ear, contains the microphone, the battery and the amplifier circuitry. The CIC component, which is shaped to fit into the ear canal of the patient in such a manner as to touch the bony portion of the ear canal, contains the hearing aid receiver, which is connected to the amplifier means.

Because the BTE and CIC components are mechanically isolated from each other, electroacoustic feedback is greatly reduced. This permits the gain of the hearing aid to be greatly increased and thereby made more suitable for patients with severe hearing loss. Additionally, because the CIC component is located so deep in the patient's ear canal as to touch the bony portion, it does not cause the patient to experience the occlusion effect. Therefore, a patient with severe hearing loss who uses a hearing aid in accordance with the invention can benefit from a higher gain without suffering from the occlusion effect.

BRIEF DESCRIPTION OF THE DRAWING

The invention will be better understood with reference to the following illustrative and non-limiting drawings, in which.

DETAILED DESCRIPTION OF A PREFERRED EMBODIMENT

Figure 2B:
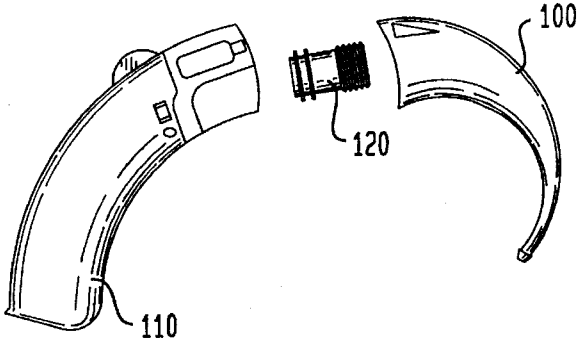
FIGS. 2A, 2B, 2C and 2D show how a component of the preferred embodiment is manufactured from a BTE hearing aid.

A BTE component 10 contains a microphone 12, amplifier circuitry 14 and a battery compartment 16. In this example, the BTE component is a BTE-type hearing aid from which the receiver has been removed.

A CIC component 18 has a shell which is molded to fit completely in the patient's hearing canal (not shown); the CIC component 18 touches the bony portion of the patient's hearing canal. A receiver 20 is located in the CIC component 18, and is connected to the BTE component 10 by a thin, flexible wire cable 22. To permit a user to easily grasp the CIC component 18 for introduction into and removal from the patient's hearing canal, a retrieval line 24 is attached to the CIC component.

In use, the BTE component 10 is placed behind the patient's ear (not shown) and the patient grasps the retrieval line 24 to install the CIC component 18 into the bony portion the ear canal. In use, electroacoustic feedback is minimal because the only mechanical connection between the BTE component 10 and the CIC component 18 is via the patient's head. Additionally, because the CIC component 18 fits so deeply into the patient's ear canal, the patient is not disturbed by the occlusion effect.

Figure 2A:
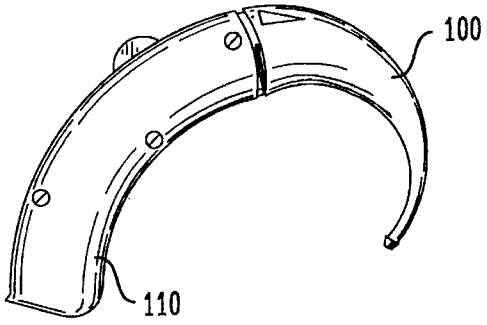
Figure 2D:
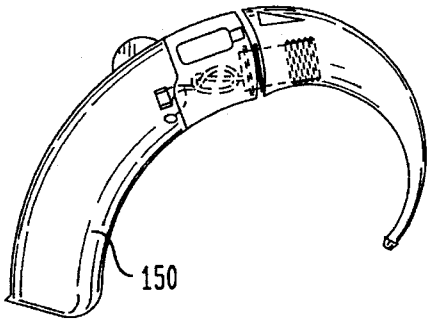
Figure 2C:
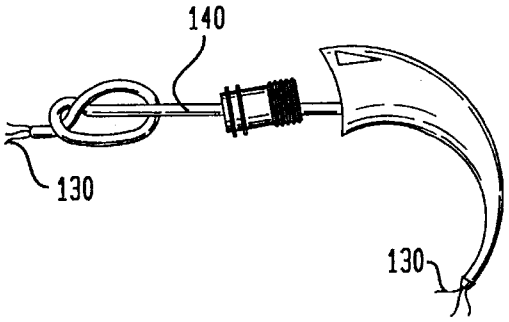
Figure 1:
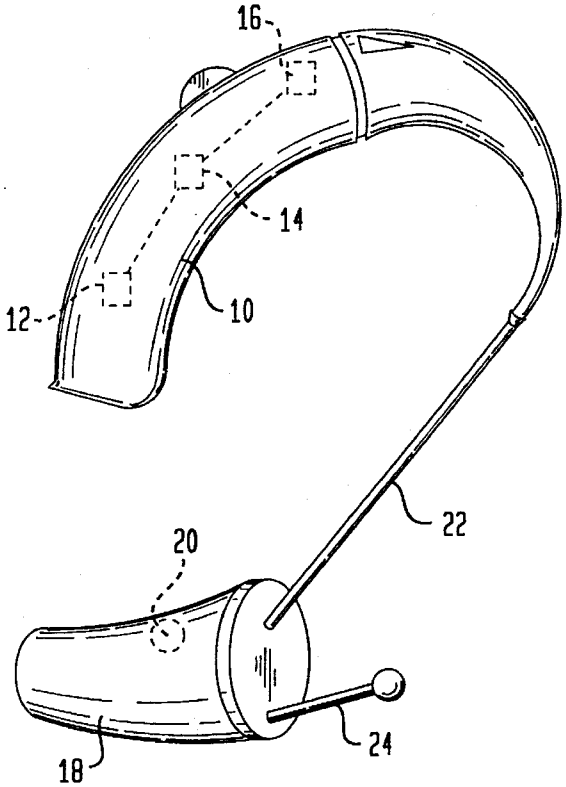
FIG. 1 shows a preferred embodiment of the invention.

In this example, the BTE component 10 is manufactured by modifying a BTE-type hearing aid such as is sold by Rexton, Inc. under the MP+ or PP-142 designations, but neither this manufacturing method nor these particular hearing aid models are parts of the invention. Referring to FIGS. 2A to 2D, to make the BTE component 10 the earhook 100 is removed from the case 110 of the hearing aid and the case is disassembled to reveal the receiver and the nubbin 120. Then, the wires for the receiver are desoldered from the remaining circuitry and the receiver with attached wires is removed. Electrical wires 130, such as 4/44 Litz wires with urethane insulation, are sheathed in a length of teflon tubing 140 to form the cable 22 and knotted at one end (to prevent the cable 22 from being pulled out through the nubbin 120 after the device has been assembled). The cable 22 is then passed through the earhook 100, the wires 130 are soldered at one end to the circuit board 150 in the BTE component 10 and are also soldered at the other end to the receiver 20. The earhook 100 and nubbin 120 are reattached to the case 110 to complete the BTE component 10. The receiver 20 is embedded in an appropriately molded CIC component 18.

The amplifier 14 may, if desired, be of the multi-channel type, may be programmable, and may contain signal processing sections (e.g. compressors, filters etc.). The electrical characteristics of the amplifier 14 are not part of the present invention. So, too, the battery compartment 16 may be of the type which swings out of the BTE component 10; the construction and location of the battery compartment are also not a part of the invention.

While in the preferred embodiment the BTE and CIC components 10 and 18 respectively are connected by a wire cable, this is not required; it may also be possible to connect these two components without a hard-wired connection (e.g. magnetically).

Although a preferred embodiment has been described above, the scope of the invention is limited only by the following claims:

We claim:

1. A hearing aid, comprising:

a behind-the-ear component, the behind-the-ear component being shaped to fit behind the ear of a patient and containing a microphone, battery receiving means and amplifier means, the amplifier means being operatively connected to the microphone and a battery received in the battery receiving means, and producing an amplified electrical signal in response to sound at the microphone; and a completely-in-canal component, the completely-in-canal component being mechanically isolated from the behind-the-ear component, being shaped to fit into the ear canal of the patient in such a manner as to touch the bony portion of the ear canal, the completely-in-canal component containing a hearing aid receiver and being operatively connected to the amplifier means.

2. The hearing aid of claim 1, wherein the behind-the-ear component and the completely-in-canal component are connected together by a wire cable.

3. The hearing aid of claim 1, wherein a retrieval line is attached to the completely-in-canal component.

* * * * *

US005606621C1

(12) EX PARTE REEXAMINATION CERTIFICATE (8147th)

United States Patent

Reiter et al.

(10) Number: US 5,606,621 C1

(45) Certificate Issued: Apr. 12, 2011

(54) HYBRID BEHIND-THE-EAR AND COMPLETELY-IN-CANAL HEARING AID

(75) Inventors: James J. Reiter, Champlin, MN (US); Gordon Berkholcs, Minneapolis, MN (US)

(73) Assignee: Hear-Wear, L.L.C., Tulsa, OK (US)

Reexamination Request:
No. 90/010,085, May 2, 2008

Reexamination Certificate for:

| | |
|---|---|
| Patent No.: | **5,606,621** |
| Issued: | **Feb. 25, 1997** |
| Appl. No.: | **08/490,214** |
| Filed: | **Jun. 14, 1995** |

(51) Int. Cl.
*H04R 25/02* (2006.01)
*H04R 25/00* (2006.01)

(52) U.S. Cl. ..... 381/328; 381/330

(58) Field of Classification Search ..... None
See application file for complete search history.

(56) References Cited

U.S. PATENT DOCUMENTS

| | | | | |
|---|---|---|---|---|
| 675,700 | A | | 6/1901 | Zimmerman |
| 1,587,643 | A | | 6/1926 | Harman |
| 1,753,817 | A | | 4/1930 | Aber |
| 1,908,850 | A | | 5/1933 | Kinsley |
| 1,952,577 | A | | 3/1934 | Bennett |
| 1,973,410 | A | | 9/1934 | Greibach |
| 2,430,229 | A | | 11/1947 | Kelsey |
| 2,445,425 | A | | 7/1948 | Gabbert |
| 2,474,135 | A | | 6/1949 | White |
| 2,487,038 | A | | 11/1949 | Baum |
| RE23,203 | E | | 3/1950 | Posen |
| 2,506,981 | A | | 5/1950 | Weaver |
| 2,513,746 | A | | 7/1950 | Rohr |
| 2,584,896 | A | | 2/1952 | Maffris |
| 2,641,327 | A | | 6/1953 | Balmer |
| 2,696,527 | A | | 12/1954 | Watson |
| 2,737,115 | A | | 9/1955 | Shelmerdine et al. |
| D178,620 | S | | 8/1956 | Trieise |
| 2,787,670 | A | * | 4/1957 | Rowland ..... 381/324 |
| 2,856,466 | A | | 10/1958 | Gustafson |
| 2,882,348 | A | | 4/1959 | Erickson |
| D185,740 | S | | 7/1959 | Criswell |
| 2,930,856 | A | | 3/1960 | Toht et al. |
| D187,988 | S | | 5/1960 | Olson |
| 2,938,083 | A | | 5/1960 | Herrmann |
| 2,939,923 | A | | 6/1960 | Henderson |
| 2,975,244 | A | | 3/1961 | Lehr |
| 3,031,537 | A | | 4/1962 | Rose |
| 3,045,073 | A | | 7/1962 | Vickerson |

(Continued)

FOREIGN PATENT DOCUMENTS

| | | |
|---|---|---|
| DE | 3502178 | 8/1985 |
| DE | 3625891 | 2/1988 |
| EP | 0494991 | 7/1992 |
| EP | 0695108 | 7/1994 |
| GB | 792742 | 4/1958 |
| JP | 62-151100 | 7/1987 |
| WO | 93-25053 | 12/1993 |

OTHER PUBLICATIONS

Ross et al. *The Volta Review,* pp. 40–44, Jan. 1980.
Vass et al., "Exploring the Deep Canal Fitting Advantage," Hearing Instruments, vol. 44, No. 12, pp. 26–27, Dec. 1993.

(Continued)

*Primary Examiner*—Lynne H Browne

(57) ABSTRACT

A hybrid BTE and CIC hearing aid has a BTE component which is worn behind the patient's ear and a CIC component which is worn in the bony portion of the patient's ear canal. The BTE and CIC components are connected together with a wire cable. Electroacoustic feedback is reduced or eliminated, allowing gain to be increased. The patient is not disturbed by the occlusion effect.

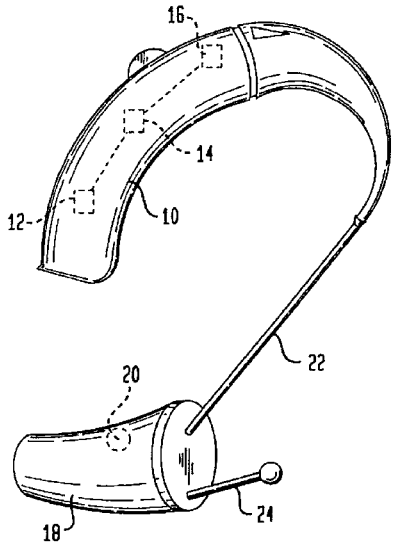

U.S. PATENT DOCUMENTS 3,061,389 A 10/1962 Bargmann
3,061,689 A 10/1962 McCarrell
3,068,954 A 12/1962 Strzalkowski
3,076,061 A 1/1963 Thompson
3,076,062 A 1/1963 Fener
3,080,011 A 3/1963 Henderson
3,098,127 A 7/1963 Huth
3,101,155 A 8/1963 Lehr
3,102,172 A 8/1963 Cohen
3,123,678 A 3/1964 Prentiss et al.
3,126,977 A 3/1964 McGee
D199,125 S 9/1964 Flygstad
3,170,046 A 2/1965 Leale
3,193,048 A 7/1965 Kohler
3,197,576 A 7/1965 Martin
3,209,080 A 9/1965 Guttner
3,209,082 A 9/1965 McCarrell et al.
RE26,174 E 3/1967 Leale
3,312,789 A 4/1967 Lewis
RE26,258 E 8/1967 Martin
3,368,644 A 2/1968 Henderson
3,385,937 A 5/1968 Lafon
3,406,461 A 10/1968 Langford
3,414,685 A 12/1968 Geib
3,439,128 A 4/1969 Sobel
3,458,668 A 7/1969 Hassler
3,470,328 A 9/1969 Daniels
3,513,269 A 5/1970 Wilson
3,524,951 A 8/1970 Bernardi
3,527,901 A 9/1970 Geib
3,536,861 A 10/1970 Dunlavy
3,665,121 A 5/1972 Weiss
3,676,611 A 7/1972 Stephens
3,783,201 A 1/1974 Weiss et al.
3,784,750 A 1/1974 Stearns et al.
D231,991 S 7/1974 Harada
3,828,142 A 8/1974 Buttner
3,880,474 A 4/1975 Scharlack
3,906,170 A * 9/1975 Guice ..... 381/322
3,927,279 A 12/1975 Nakamura et al.
3,934,100 A 1/1976 Harada
4,006,321 A 2/1977 Carlson
4,041,251 A 8/1977 Kaanders
4,068,090 A 1/1978 Komatsu et al.
4,069,400 A 1/1978 Johanson et al.
4,090,040 A 5/1978 Berland
4,099,035 A 7/1978 Yanick
4,133,984 A 1/1979 Akiyama
D251,234 S 3/1979 Hakansson et al.
4,259,547 A 3/1981 Valley et al.
4,291,203 A 9/1981 Bellafiore
4,303,120 A 12/1981 Carini
4,311,206 A 1/1982 Johnson
4,335,281 A 6/1982 Scott et al.
4,354,065 A 10/1982 Buettner
4,366,349 A 12/1982 Adelman
4,375,016 A 2/1983 Harada
4,381,830 A 5/1983 Jelonek et al.
4,418,787 A 12/1983 Eggert et al.
D272,904 S 3/1984 Kawano
D273,706 S 5/1984 McCall
4,451,709 A 5/1984 Waxman
4,456,795 A 6/1984 Saito
4,472,603 A 9/1984 Berg
4,476,353 A 10/1984 Haertl
4,484,345 A 11/1984 Stearns
4,508,940 A 4/1985 Steeger
4,520,236 A 5/1985 Gauthier
4,539,440 A 9/1985 Sciarra
4,584,437 A 4/1986 Giannetti
4,585,089 A 4/1986 Topholm
4,622,440 A 11/1986 Slavin
4,622,692 A 11/1986 Cole
4,628,527 A 12/1986 Henneberger et al.
4,628,907 A 12/1986 Epley
4,638,125 A 1/1987 Buettner
4,677,679 A 6/1987 Killion
4,689,819 A 8/1987 Killion
4,710,961 A 12/1987 Buttner
4,727,582 A 2/1988 De Vries et al.
D294,862 S 3/1988 Diefenbach
4,739,512 A 4/1988 Hartl et al.
4,783,816 A 11/1988 Buttner et al.
4,803,732 A 2/1989 Dillon
4,817,609 A 4/1989 Perkins et al.
4,821,247 A 4/1989 Grooms
4,870,688 A 9/1989 Voroba et al.
4,887,299 A 12/1989 Cummins et al.
4,893,344 A 1/1990 Tragardh et al.
4,912,769 A 3/1990 Erbe
4,962,537 A 10/1990 Basel et al.
4,965,831 A 10/1990 Schmid
4,980,928 A 1/1991 Ellis
5,002,151 A 3/1991 Oliveira et al.
5,031,219 A 7/1991 Ward et al.
5,046,580 A 9/1991 Barton
D322,481 S 12/1991 van Mourik
5,091,952 A 2/1992 Williamson et al.
5,195,139 A 3/1993 Gauthier
5,201,007 A 4/1993 Ward et al.
5,265,168 A 11/1993 Schiess et al.
5,341,433 A 8/1994 Meyer et al.
5,357,576 A 10/1994 Arndt
D354,568 S 1/1995 Araki et al.
5,381,484 A 1/1995 Claes et al.
5,390,254 A 2/1995 Adelman
5,395,168 A 3/1995 Leenen
5,408,534 A 4/1995 Lenzini et al.
5,533,130 A 7/1996 Staton
5,606,621 A 2/1997 Reiter et al.
5,675,657 A 10/1997 Giannetti
5,701,348 A * 12/1997 Shennib et al. ..... 381/328
5,757,935 A 5/1998 Kang et al.
5,864,628 A 1/1999 Posen et al.
5,887,070 A 3/1999 Iseberg et al.
5,987,146 A 11/1999 Pluvinage et al.
6,009,183 A 12/1999 Taenzer et al.
6,101,259 A 8/2000 Rapps
6,445,799 B1 9/2002 Taenzer et al.
7,113,611 B2 9/2006 Leedom et al.

OTHER PUBLICATIONS

Mueller, "CIC Hearing Aids: What is their Impact on the Occlusion Effect," *The Hearing Journal,,* vol. 47, No. 11, pp. 29–35, Nov. 1994.

Bryant, et al., "Minimal Contact Long Run Canal ITE Hearing Instruments," *Hearing Instruments,* vol. 42, No. 1, pp. 12–15 and 48, 1991.

*The Hearing Journal,* vol. 47, No. 6, Jun. 1994, p. 55, advertisement for Micro–Tech, CIC.

*Hearing Instruments,* vol. 40, No. 1, 1989, p. 34, advertisement for Phonic Ear ITE Lab, model PE903.

*The Hearing Journal,* vol. 47, No. 9, Sep. 1994, unmarked p. 22, advertisement for Tymp2000 CIC.

Oticon Inc.'s Responses to Hear–Wear Technologies, LLC's First Set of Interrogatories, In the matter of *Hear–Wear Technologies, LLC* v. *Oticon, Inc., et al.,* Civil Action No. 4:07–cv–212, in the US District Court for the Northern District of Oklahoma (Redacted by Applicant).

Phonak LLC's Responses to Plaintiff's First Set of Interrogatories (Nos. 1–19), In the matter of *Hear–Wear Technologies, LLC* v. *Oticon, Inc., et al.,* Civil Action No. 07–cv–212CVE–SAJ, in the US District Court for the Northern District of Oklahoma (Redacted by Applicant).

PCT Search Report (PCT/US02/024960) dated Mar. 18, 2003, 5 pgs.

European Examination Report issued for EP 02 752 712.6 dated Aug. 31, 2006, 4 pgs.

PCT Search Report for Application No. PCT/US96/007910 (Sep. 26, 1996) 5 pgs.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-3 is confirmed.

New claim 4 is added and determined to be patentable.

*4. The hearing aid of claim 2 wherein the wire cable comprises a thin flexible insulated wire cable, and wherein the thin flexible insulated wire cable is the only connection between the behind-the-ear component and the completely-in-canal component and provides the mechanical isolation between the behind-the-ear component and the completely-in-canal component.*

* * * * *

US005606621C2

(12) EX PARTE REEXAMINATION CERTIFICATE (9134th)

United States Patent
Reiter et al.

(10) Number: US 5,606,621 C2
(45) Certificate Issued: Jul. 10, 2012

(54) HYBRID BEHIND-THE-EAR AND COMPLETELY-IN-CANAL HEARING AID

(75) Inventors: James J. Reiter, Champlin, MN (US); Gordon Berkholes, Minneapolis, MN (US)

(73) Assignee: Hear-Wear, L.L.C., Tulsa, OK (US)

Reexamination Request:
No. 90/011,554, Mar. 8, 2011

Reexamination Certificate for:

| | |
|---|---|
| Patent No.: | **5,606,621** |
| Issued: | **Apr. 12, 2011** |
| Appl. No.: | **08/490,214** |
| Filed: | **Jun. 14, 1995** |

Reexamination Certificate B1 5,606,621 issued Feb. 25, 1997

(51) Int. Cl.
*H04R 25/02* (2006.01)
*H04R 25/00* (2006.01)

(52) U.S. Cl. ..... 381/328; 381/330
(58) Field of Classification Search ..... 381/68.6
See application file for complete search history.

(56) References Cited

To view the complete listing of prior art documents cited during the proceeding for Reexamination Control Number 90/011,554, please refer to the USPTO's public Patent Application Information Retrieval (PAIR) system under the Display References tab.

*Primary Examiner*—Michael J. Yigdall

(57) ABSTRACT

A hybrid BTE and CIC hearing aid has a BTE component which is worn behind the patient's ear and a CIC component which is worn in the bony portion of the patient's ear canal. The BTE and CIC components are connected together with a wire cable. Electroacoustic feedback is reduced or eliminated, allowing gain to be increased. The patient is not disturbed by the occlusion effect.

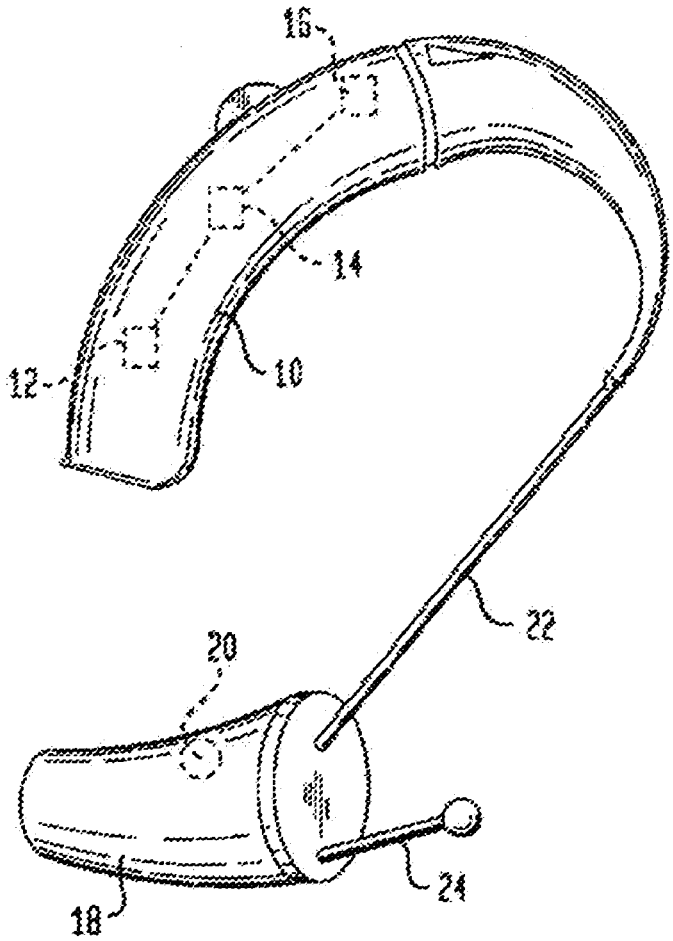

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-4 is confirmed.

* * * * *